US005137752A

United States Patent [19]

Mills

[11] Patent Number: 5,137,752

[45] Date of Patent: Aug. 11, 1992

[54] GYPSUM WALLBOARD TAPING SYSTEM

[76] Inventor: Gregory B. Mills, P.O. Box 692, Newport Beach, Calif. 92661-0692

[21] Appl. No.: 633,320

[22] Filed: Dec. 24, 1990

Related U.S. Application Data

[62] Division of Ser. No. 320,272, Mar. 7, 1989, Pat. No. 4,996,941.

[51] Int. Cl.[5] ..... B05D 3/12

[52] U.S. Cl. ..... 427/179; 427/207.1; 427/439

[58] Field of Search ..... 118/419, 423; 156/527, 156/575, 577, 578, 579; 427/207.1, 209, 430.1, 179, 439

[56] References Cited

U.S. PATENT DOCUMENTS

| | | | |
|---|---|---|---|
| 387,541 | 8/1888 | Roe | 242/84.8 |
| 591,747 | 10/1897 | Eddy | 242/84.8 |
| 2,741,220 | 4/1956 | Belisle | 118/405 |
| 2,873,881 | 2/1959 | Nichols | 220/4 A |
| 3,112,225 | 11/1963 | Harms | 156/527 |
| 3,344,770 | 10/1967 | Schaefer | 118/428 |
| 4,202,288 | 5/1980 | Davy | 118/424 |
| 4,689,107 | 8/1987 | Entwistle | 156/531 |
| 4,758,291 | 7/1988 | Fechner et al. | 156/575 |

*Primary Examiner*—Michael Lusignan
*Attorney, Agent, or Firm*—Hawes & Fischer

[57] ABSTRACT

This invention relates to a labor saving system and related tools for gypsum wall board tape installation. The system consists of two elements;

1. pre-processing paper drywall tape by pre-coating both sides with wet adhesive mud,
2. which tape is then rolled up for convenient storage and handling for later application.

The embodiment of the system's two elements are two mechanical tools; the taper tool and the mud coating tool.

The mud coating tool includes three mechanical elements; a standard five gallon pail, and a cylindrical vertical extension for the pail, which supports a special frame.

The frame includes a reel for a roll of drywall tape which is suspended above the pail of wet drywall mud. The frame also forms the tape path which threads the tape through the mud coating bucket. A roller on the bottom of the frame directs the tape down through the wet mud. A wiping apparatus deflects the tape path upwards and removes excess mud which falls back into the bucket. The coated tape is reeled into the taper tool.

The shaft of the crank within the hollow body of the taper tool has a hook built in which removably attaches the end of the tape to the shaft for rolling muddy tape into the hollow body. When the reel is full of tape, the tape is torn off on a serrated edge on the taper tool or a serrated edge on the bucket. The taper tool is then ready to later unroll and embed the pre-coated tape upon a drywall surface.

8 Claims, 8 Drawing Sheets

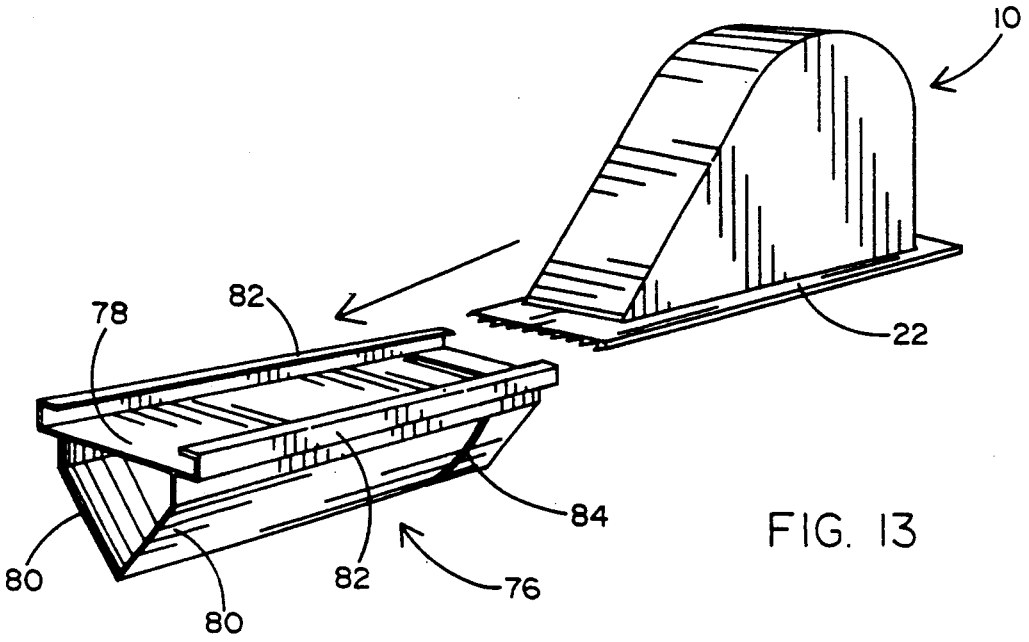
FIG. 13
FIG. 14
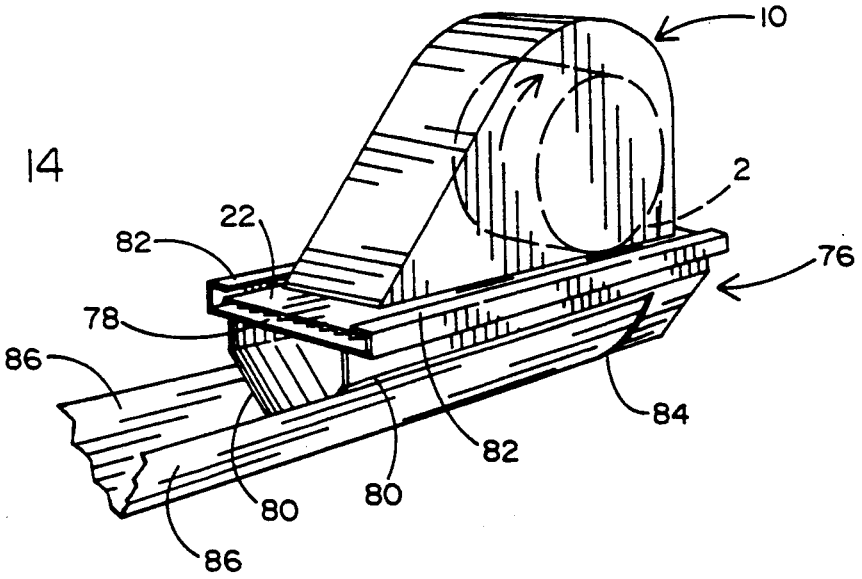
FIG. 15
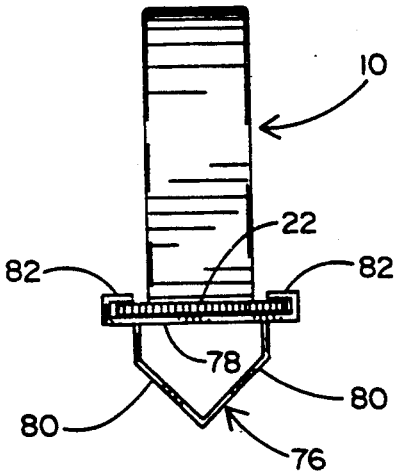

GYPSUM WALLBOARD TAPING SYSTEM

This is a division of application Ser. No. 320,272, filed Mar. 7, 1989, now U.S. Pat. No. 4,996,941.

BACKGROUND OF THE INVENTION

1. Field of the Invention

This invention relates to a simplified, potential low cost system for drywall tape installation.

Since the tape is fully imbedded after only one operation, there is a reduction in labor to complete the drywall taping procedure.

2. Background Art

The repetitive and laborious process of taping drywall has lead to several systems of taping, each of which have serous undersirable limitations.

Since the advent of drywall technology, the taping of the seams created when sheets of drywall are nailed in place has been a pedestrian exercise in handling the paper tape and adhesive wet mud. The components are currently sold separately and are combined only upon actual application with all prior art.

In the time consuming manual application of the taping materials, the adhesive mud is manually scooped out of a container and applied with a smearing action to drywall seams with a drywall knife. Then dry paper tape is un-rolled and laid upon the adhesive surface and wiped down onto the wet mud. The tape is later top coated with more mud and wiped smooth after each coat to flatten the surface. The materials are allowed to dry between coats.

One layer of mud goes under the tape to achieve adhesion and at least two layers of mud are commonly applied over the tape to "embed" the tape within the mud. The mud is allowed to dry between coats. Mud is applied to the drywall seams and wiped down until the mud appears smooth and the gap between the drywall panels are made flat.

The predominate commercial taping system in use, is the Ames system. The Ames system consist of a series of tools designed to handle both dry, non-adhesive paper tape and wet adhesive mud to make the application procedure faster than manual installation.

The Ames system tape tools consist of; a manual mud pump, a taper tool, roller, finishers and a standard drywall knife. Many of the Ames tools are complex, rather expensive and require extensive training, adjustment and manual dexterity to operate.

In the Ames system the drywall mud is pumped out of a bucket into a cylinder within the Ames taper. The Ames taper tool holds a roll of dry paper tape. When the cylinder is full of mud the taper is held against the seam and the taper head is rolled along the seam. The cylinder is emptied of the mud it holds, as a wheel on the head which contains a pulley, reels up a steel cable attached to a piston within the cylinder. The mud then exits the tool out a hole at the head as dry paper tape is rolled onto the mud as it is ejected upon the wall.

The seam must be "wiped down with a drywall knife to complete the taping operation with the Ames system. The seam then requires a top coat of mud to fully imbed the tape.

With the Ames system full embedding occurs only after three operations; Tape and mud application to the drywall, wiping the tape down and then top coating the seam.

The previously mentioned tools have various limitations and short comings. The Ames system is very expensive as it requires many unique part be machined and the tools maintained in proper adjustment. The taper tool is heavy and hard to use. The Ames taper requires that many precision parts operate in the hostile environment of gritty, adhesive viscous drywall mud. The tool must be cleaned, oiled and adjusted often to not breakdown or become jammed and stop working. Parts wear out and break requiring substantial maintenance and expense. The Ames taper does not apply mud to the top side of the drywall tape.

A more primitive taping tool called the "banjo" utilizes the concept of a reel of dry tape that is threaded though a chamber of wet mud as it exits the tool and the muddy tape is then directly applied to the drywall for manual wipe down. As the banjo concentrates all the mud under the tape, very little mud ends up on the back side of the tape. With a banjo taper another coat of mud must be applied to fully embed the tape.

The banjo is slow and inefficient as the mud may not properly and fully coat the underside of the tape, leaving a dry blister under the tape. The banjo is heavy and awkward to use and requires that the muddy tape be wiped down after it is unrolled upon the drywall seam. The banjo will not readily do inside corners and does not apply mud to both sides of the drywall tape.

It would be desirable to have an effective labor saving system that is inexpensive to manufacture, easy to use and light weight. The system should be able to operate in the hostile environment of the materials and not be adversely affected by the mud drying and or a failure to thoroughly clean the tools after each use.

The system should utilize current materials and procedures common to the drywall taping industry. Use of the tools should be natural and easy to learn. It would be desirable to reduce the occurrence of blisters of air which occasionally occur under the tape. The system should fully embed the drywall tape in the initial application; thus reducing the number of required steps and eliminating some labor.

SUMMARY OF THE INVENTION

In general terms, a low cost drywall taping embedding system utilizing two major tools is disclosed. This system is simple easier to use and more efficient than it's predecessors outlined above.

The system embodiment consists of two parts; the mud coating tool and the taper tool.

THE TAPE COATING BUCKET

The tape coating bucket consists of three elements

1. A standard 5 gallon plastic bucket in which drywall mud is commonly sold and or stored.

2. A special cylindrical collar that will fit on a standard 5 gallon bucket and provide support, alignment, and function to the frame and tape reels. The collar with its holes and support functions also will receive a standard 5 gallon lid to allow the bucket to be sealed with the mud bucket section left in place. The collar may be motorized. See FIGS. 17

3. The tape reel and frame which is removeable for cleaning and may be motorized similarly to FIGS. 17

4. There may be upon the collar a serrated edge for cutting off tape.

DRYWALL TAPE APPLICATION TOOL (taper)

The taper tool consist of a hollow body with a flat section and a shaft centrally located as to allow muddy tape to be rolled up within.

1. The hollow body contains and holds a roll of pre-mudded tape and forms a section which will lay flat against the drywall surface.

2. The shaft with a small protruding hook catches the end of tape from a mud bucket and reels it onto the shaft.

3. The crank for the shaft may be hinged and recessed within the crank mechanism when not in use. (The crank may be powered for reloading by a coupling with a powered mud bucket.)

4. The trailing edge of the taper tool has a saw toothed edge to allow easy cut off of the tape at any point.

5. An attachment may be slid onto the taper to allow the taping of inside corners. The shoe device when removably attached feeds and folds the tape into inside corners as the taper is slid along inside the corner. See FIGS. 14, 15 and 16.

COMMERCIAL TAPE COATING MACHINE

The commercial tape coating and re-rolling machine is designed to mass produce pre mudded drywall tape for packaging and sale within a disposable package/-taper.

The commercial tape coating machine consist of;

1. Multiple rollers upon which rolls of paper tape can be reeled out into . . .

2. a trough with rollers deep within to force dry paper tape down through the mud bath and out to . . .

3. an adjustable wiper which regulates the amount of mud left on the tape . . .

4. a pair of rollers with narrow teeth upon a reel are spring loaded to pull together and grip the tape without squeezing mud off the tape. See FIGS. 7 . . .

4 which is then cut to a convenient length and re-rolled for packaging in the disposable taper.

This machine would be powered at the take up reels and or immediately after the wipers . . .

DISPOSABLE DRYWALL TAPE TOOL

The disposable version of the taper tool contains no crank and may be manufactured and sold with a factory coated and re-rolled segment of drywall tape within. The low cost of plastic vacuum forming technology allows the cost effective disposable use of this one part tool. See FIGS. 3, 18, 19 and 20.

1. A hollow body contains and holds a pre-coated roll of drywall tape and provides a flat flap which is folded over to form the base plate and seal flap.

2. The base plate contains a slot to allow the exit of the tape as it is unrolled.

3. A seal flap is sealed down to the base plate covering the slot and a short segment of tape which protrudes to give the user a way to begin to unreel the tape.

A. Fold in crank handle

B. serrated edge for tape cut off

Figure 3:
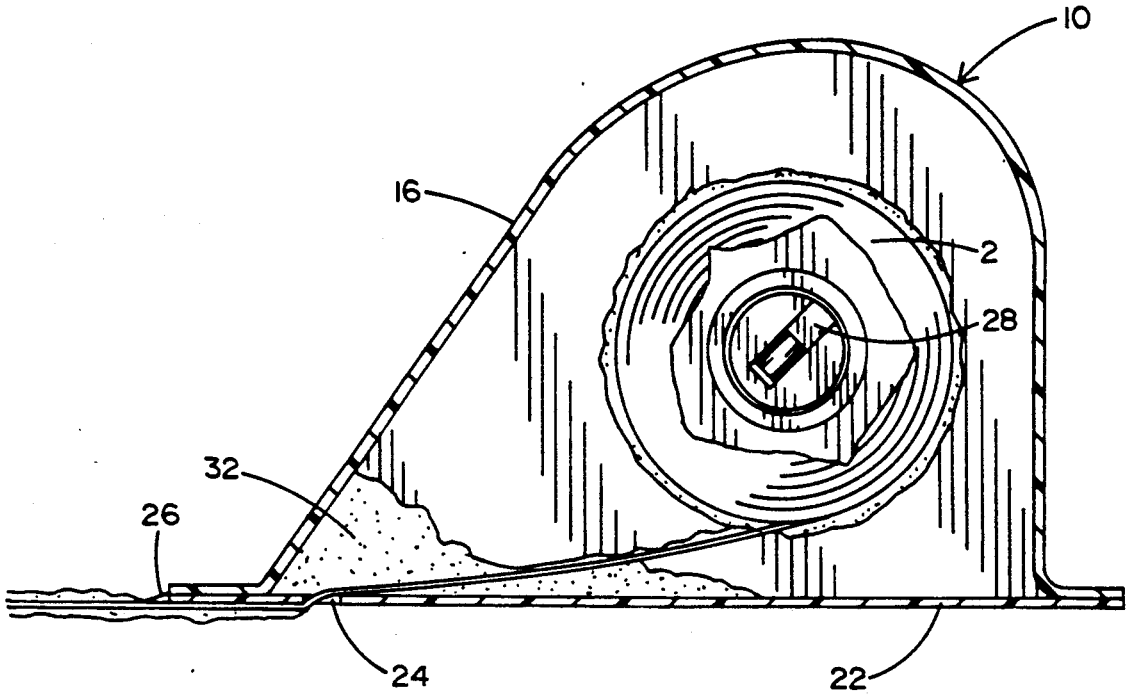

FIGS. 3. The disposable taper opened up to show muddy tape being loaded.

A. Tape exit slot

B. Seal pull tab

C. roll of muddy tape

Figure 4:
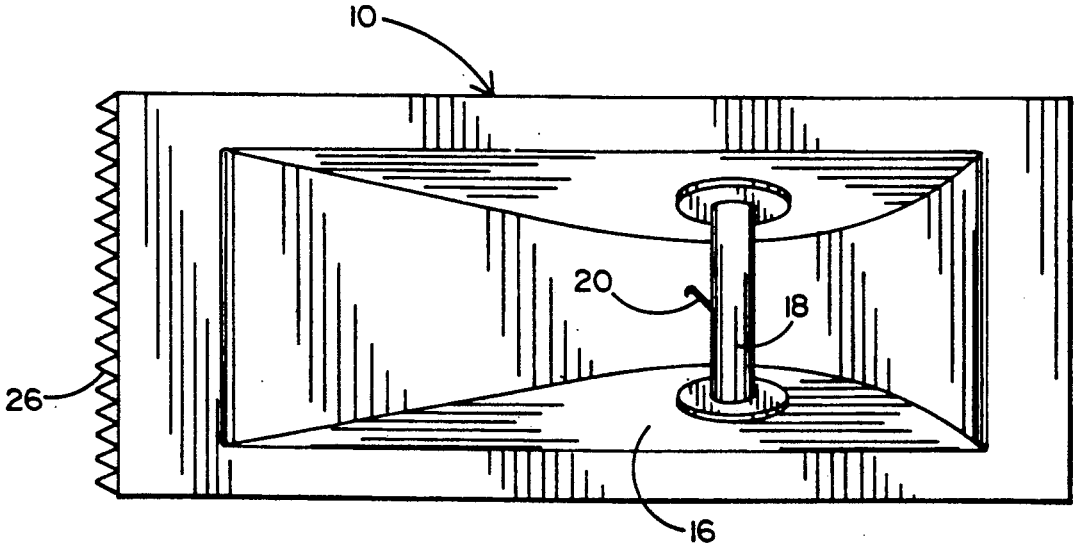

FIGS. 4. bottom view of disposable taper

A. Side X-ray view showing tape path

B. Bottom view showing tape exposed, xxx denotes seal line

Figure 5:
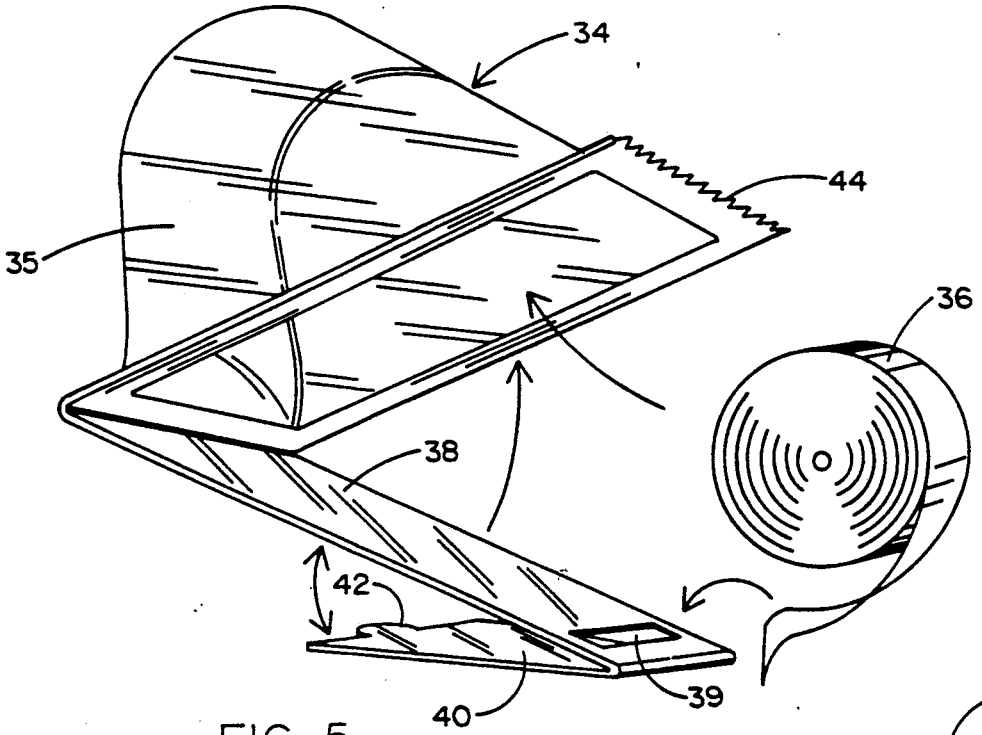

FIGS. 5. Details of tape embedding process

Figure 6:
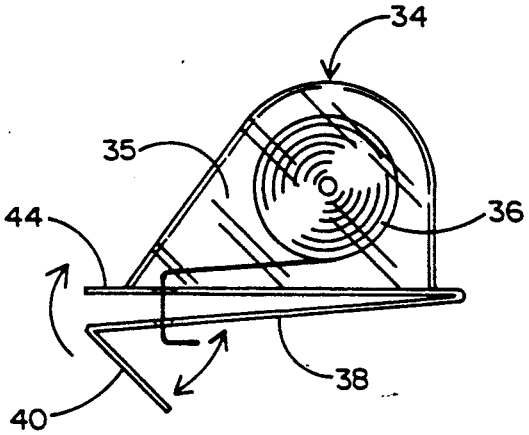

FIGS. 6. High speed commercial tape coating machine tape

A. Top toothed disks spaced apart forming top power roller

B. Bottom toothed roller

C. Take up reel for processed tape

D. Supply reel for 500 foot rolls of dry tape

E. Mud tank

F. Mud level

G. bottom roller in mud bath

Figure 7:
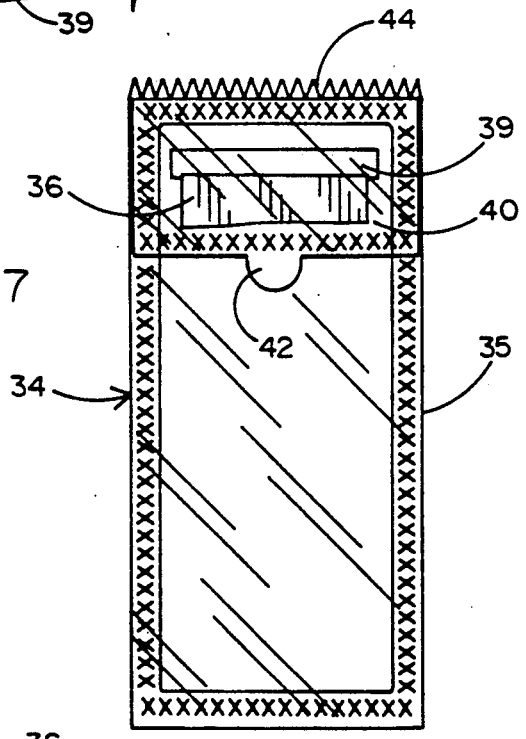

FIGS. 7. The commercial tape coater and re-roller threading schematic

A. Top toothed disks spaced apart forming top power roller

B. Bottom toothed roller

C. Take up reel for processed tape

D. Supply reel for 500 foot rolls of dry tape

E. Mud tank

F. Mud level

G. bottom roller in mud bath

Figure 8:
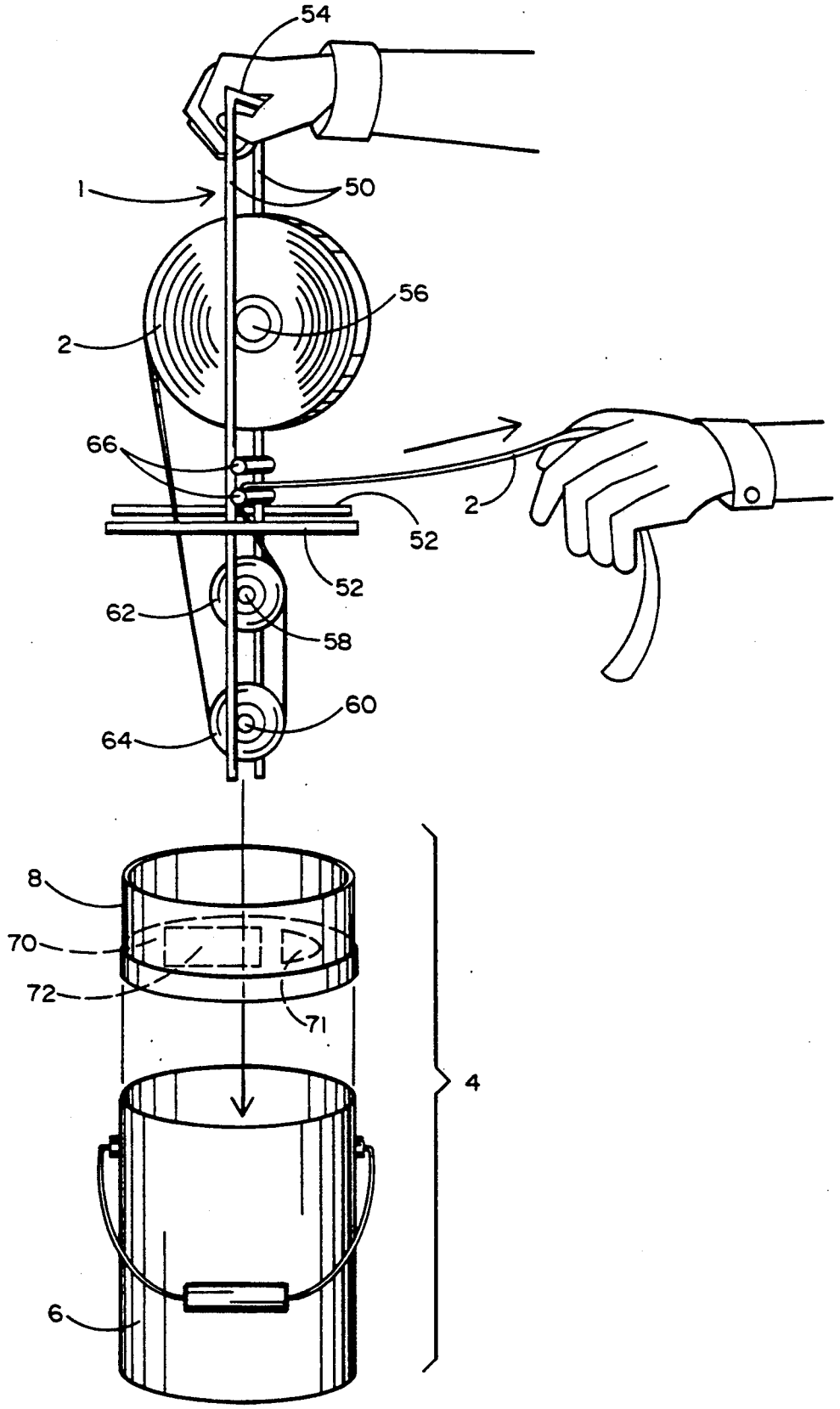

FIGS. 8. Assembly of the parts of a mud bucket tool.

A. Frame with tape threaded through tape path

B. Tool collar

C. Standard 5 gallon size pail

Figure 9:
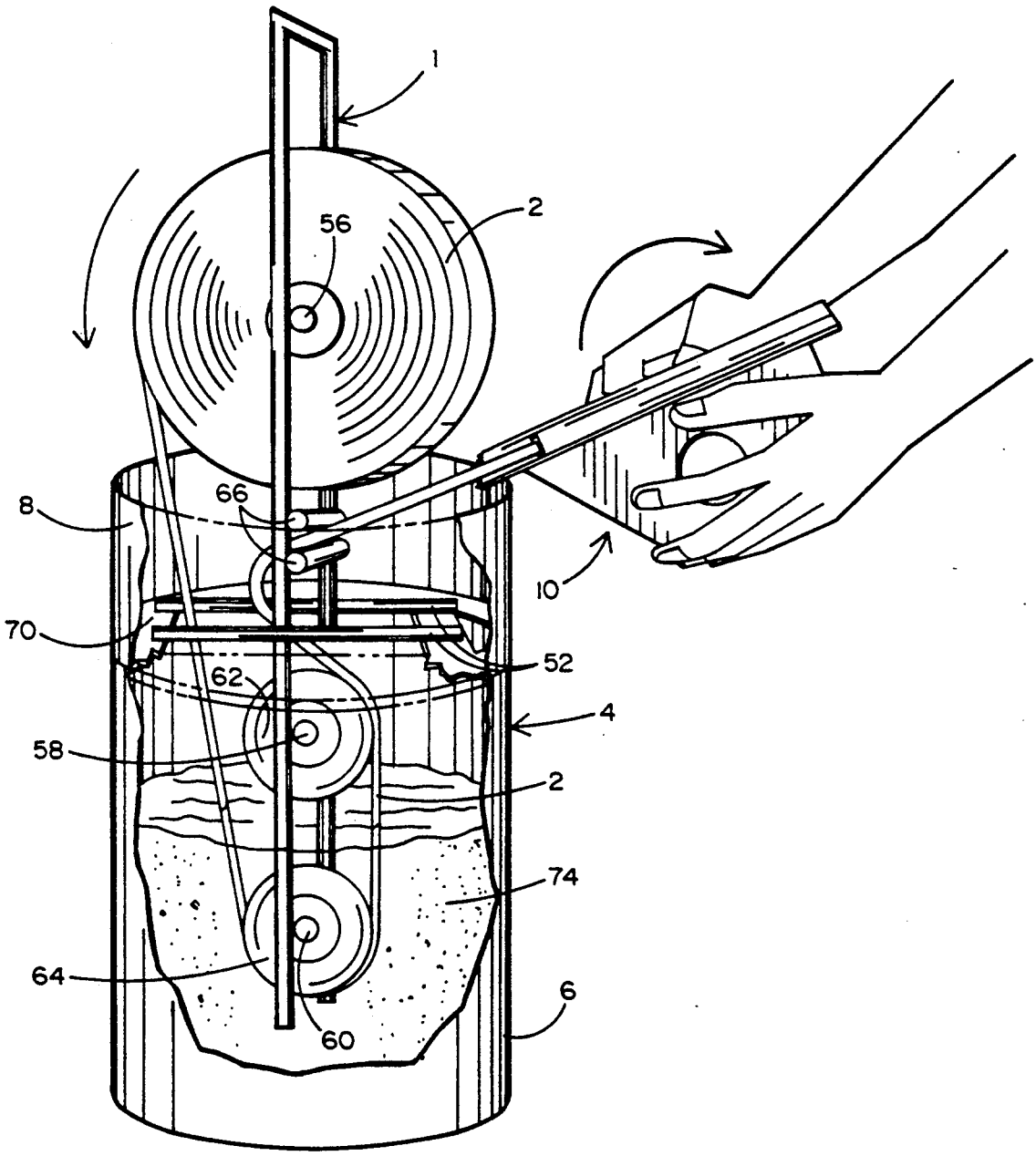

FIGS. 9. X-ray view of tape coating and rolling tape into taper tool.

A. 500 foot long roll of dry, drywall tape

Figure 10:
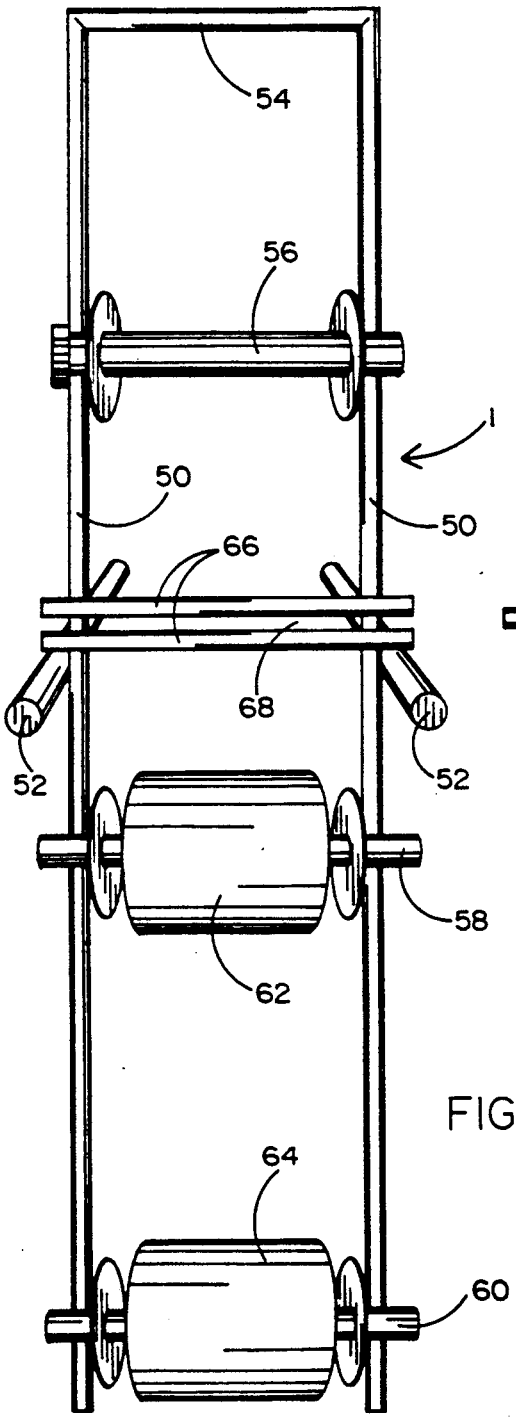

FIGS. 10. front view of frame

Figure 11:
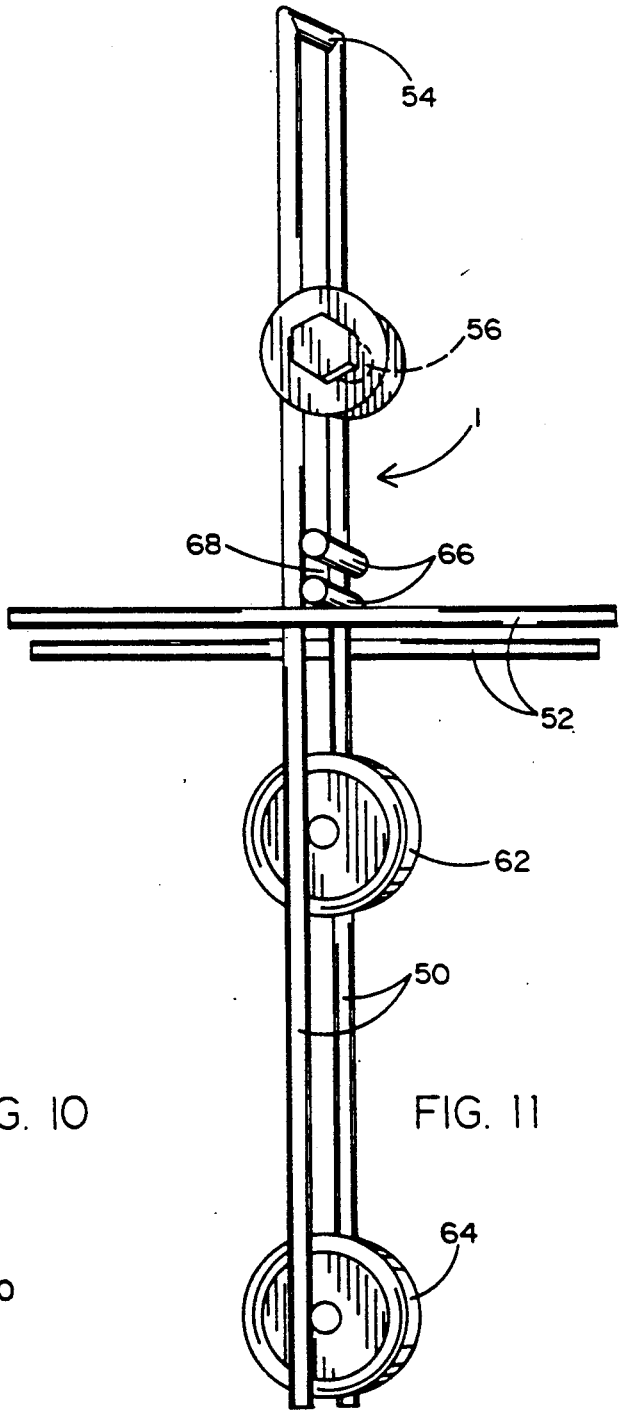

FIGS. 11. side view of frame

Figure 12:
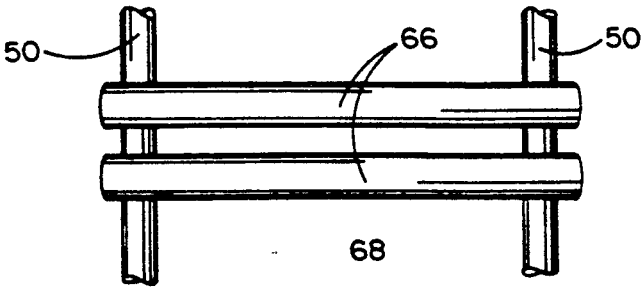

FIGS. 12. close-up of mud wipers and wiping gap. The following are common to 10, 11 and 12

A. Removeable shaft for fresh drywall tape reel

B. Separation roller

C. Bottom roller to immerse tape in mud

D. Mud wipers (2) forming slot

E. Mud wiping slot

FIGS. 13. bottom view of standard taper showing shaft and hook for holding the end of a roll of muddy tape A. Hook for removably attaching muddy tape on reel for rolling B. Tape receiving roller for reel effect C. Hollow body of taper D. Serrated edge for tape cut off FIGS. 14. corner tool attachment being slipped on A. corner tool attachment B. Hollow taper body FIGS. 15. corner tool attachment in use A. corner tool attachment B. Hollow taper body FIGS. 16. end view of corner tool attachment A. corner tool attachment B. Hollow taper body FIGS. 17. Optional motorized mud bucket collar A. motor B. Gear reducer C. Bottom toothed disks spaced apart on shaft from motor D. Top toothed shaft, spring loaded to bottom roller
E. left spring for attraction to other roller
F. Plate with slot to allow spring loaded movement of D FIGS. 18, 19 and 20 one piece vacuum molded plastic disposable taper A. Hollow taper body
B. Bottom plate flap
C. Slot for tape exit
D. seal segment flap
E. pull tab to open seal
F. fold line
G. Fold line
H. Serrated cutting edge

DESCRIPTION OF THE PREFERRED EMBODIMENT

The system for drywall tape installation disclosed herein is best described while referring to the drawings where (FIG. 1 and 9) illustrates in the use in loading mode and (FIGS. 5) illustrates the taper in use.

THE COLLAR

The mud coating bucket collar is a cylindrical extension of the bucket approximately 6 inches high. See FIGS. 8 B. This collar fits and attaches to the rim of a standard drywall mud pail. The collar snaps into place like a standard pail lid. The lid from a standard drywall pail will the fit the top rim of the mud bucket collar to allow storage of the drywall mud in a ready to use condition within the mud coating bucket.

The collar has a diaphragm with holes therein to allow the addition of more wet drywall mud and a special hole and support attachments for the frame which is inserted though the diaphragm.

THE FRAME

The frame is described as a removably attachable device which holds a reel of drywall tape. The frame fits through a hole in the diaphragm of the collar and sit upon the diaphragm and is attached thereto. The frame provides a tape path which leads into the mud. The tape path then leads out of the mud and through a gap which wipes excess mud off the tape.

THE TAPER TOOL

The taper tool is described as a hollow body with a flat section. There is within the hollow body a crank shaft which has a hook mounted thereon. There is a crank handle on the outside of the taper. The flat section has a serrated edge.

CORNER TOOL

In the case of taping an inside corner, the taper tool has a separate part: the corner tool attachment, which removably attaches to the taper tool to form the inside corner form for the tape. The muddy tape is threaded thought the corner tool attachment. Which attachment also has the function of folding the drywall tape in half at the center fold line which is customarily embossed into standard paper drywall tape in it's manufacture. The corner tool attachment when installed becomes the sliding and embedding surface on the bottom of an taper. See FIGS. 14, 15, and 16

MASS PRODUCTION TAPE COATER

The two elements of the system have further applications flowing from the system's concept beyond, one bucket of mud and one roll of tape. The tape coating device is numerically expandable and the precoating process allows storage of the two basic materials in a new form . . . , ready to use pre-mudded tape.

The commercial tape coating and re-rolling machine herein disclosed supports many rolls of dry paper tape which are all at once dipped though the trough under a roller and then out trough pinch wipers which can be set to adjust the amount of mud left upon both front and back of the tape. The tape is re-rolled as the tape is threaded out of the machine.

With a large mass production tape coater, there is no practical limit to the number of rolls of drywall tape that could be mud coated at once. Rolls can be placed side by side in long columns that gang up multiple rolls upon multiple layers to mass produce pre-mudded drywall tape. The pre-mudded tape is then cut down in length re-rolled and packaged in a disposable taper tool. See FIGS. 6 and 7.

DISPOSABLE TAPER TOOL

The pre-coated and rolled tape is placed and sealed within the hollow plastic containers which are also disposable application tools.

The disposable taper tool is described as a hollow plastic body with an attached, slotted, flat base plate and an air tight seal. The disposable taper tools will be one part, light weight vacuum formed plastic such as styrene of such a mil thickness as to be structurally functional but economical discarded after one use. See FIGS. 3,4,18,19, and 20

In the production and loading of the disposable taper, a roll of drywall tape that has been coated with mud on both sides and re-rolled on a mass production tape coater, is placed within the hollow plastic body. The base plate with a tape exit slot is laid upon the bottom of the plastic body covering the cavity. The end of the tape is withdrawn though the slot. A 2 inch end of the tape is folded over the outside surface of the base plate and a seal is placed over the tape and slot. The three layers are then sealed with heat or adhesive to create a water proof package that doubles as a dispenser tool after the seal is removed. The sealed disposable tapers with the seal in place are then labeled for sale as a convenience product.

Anti-bacterial additives and the water proof sealed container would allow such pre-coated drywall tape an approximately a one year shelf life.

The disposable taper tool is functionally similar to the standard taper tool, except that the disposable version has no crank to allow reloading of the device since it is factory pre-loaded with a roll of muddy tape for one use only. See FIGS. 3,

PREPARATION FOR USE

A person who is preparing to use the system would thin to the proper viscosity, an all purpose or taping type gypsum drywall mud compound in a 5 gallon pail. The recommended viscosity is that that pancake batter might have. The bucket may be used nearly full of mud.

To prepare the mud coating bucket for use, the collar is attached to the top rim of the mud pail. The frame fits securely within the collar. FIGS. 8 A, B and C.

The frame is loaded with a roll of tape which is threaded through the tape path. The bottom of the frame is then inserted into the mud though the holes provided within the mud bucket collar. The frame is snapped into retaining fasteners. The tape is pulled though the tape path until muddy tape emerges. The first 24 inches of tape is dry leader which is torn off and discarded. The mud coating bucket is ready to use. See FIG. 8

In the coating process the dry paper tape rolls off the reel and down into the wet mud. The tape is drawn completely into the wet mud for total immersion and wetting, the tape is coated on both sides. The muddy tape is then threaded up through rollers and a wiping apparatus to regulate the amount of wet drywall mud remaining on the tape. The wet, mud coated drywall tape is then reeled out of the mud bucket and into the second tool and second element of the system. See FIGS. 9, The muddy tape as it exits the mud bucket is rolled directly onto a reel within the taper tool.

To load the taper tool it is inverted and held in position at the rim of the mud coating bucket. The end of the muddy tape is hooked upon the shaft of the taper reel and the tape is reeled up into the taper hollow body until the crank is full. The operator then stops reeling tape in and cuts off the tape upon the serrated edge of the taper. The taper is now loaded and ready to use.

To use the taper tool, one would pull a short section (approximately 0.2") length) of the muddy tape out of the taper tool and temporarily secure the tape to the drywall surface by pressing it down with a fingertip. See FIGS. 2

As the taper tool is then laid flat, it is slid along while centered upon the drywall seam. When a sufficient length of tape (approximately 12") has been applied and automatically wiped down to avoid undesirable slippage of the tape segment, the finger can be removed See FIGS. 2

As the taper is slid along the wall, the tape is unrolled and the bottom rear edge of the taper forces the tape down and wipes the seam in one operation. The taper tool fully embeds the tape in one operation.

The advantages of the disclosed system are numerous. The tape thus installed is embedded in one operation resulting in fewer air blisters developing under the tape than prior art systems. The combination of initial embedding along with the softened condition of the tape produces a better tape joint.

This system will work as well as competitive systems that are many times as expensive. This system is easy to operate and is much faster, more precise and convenient than prior art systems. The disclosed taper tool and mudding bucket are natural and easy to use without training required to operate other systems.

Along with the elegant simplicity of the taper, the size and weight are reduced dramatically. The simplicity also enhances the reliability of the taper. The absence of a complex mechanical apparatus will result in a tremendous reduction in breakdown and repairs.

The simplification of the taper and mud coater elements result in a simple and cheap set of tools to manufacture.

It will be apparent that while a preferred embodiment of the invention has been shown and described, various modifications and changes could be made without departing from the true spirit and scope of the invention.

Having thus set forth a preferred embodiment of the invention, what is claimed is:

1. A method for coating drywall tape with adhesive mud, and storing said coated tape for future use, said method comprising the steps of:
   filling a reservoir with a bath of mud;
   suspending a roll of uncoated drywall tape above said reservoir;
   unwinding the uncoated tape from its roll and immersing said tape in the mud bath of said reservoir such that the drywall tape is coated on both sides thereof with mud; and
   winding the coated drywall tape into a finished roll and storing said finished roll in a housing having an opening through which said coated tape is to be dispensed in the future.

2. The method recited in claim 1, including the additional step of removably sealing the opening of said housing in which the finished roll of mud coated tape is stored.

3. The method recited in claim 1, including the additional steps of forming said housing with an open end, locating said roll of mud coated tape within said housing by way of said open end, and sealing a closure across said open end after said roll is located within said housing.

4. The method recited in claim 3, including the additional step of forming the opening in said housing through said closure.

5. The method recited in claim 1, including the additional steps of forming said housing out of disposable material and disposing of said housing after all of the mud coated tape that is stored within said housing has been dispensed therefrom.

6. The method recited in claim 1, including the additional steps of locating a shaft at the interior of said housing, attaching the leading edge of said mud coated tape to said shaft, and winding the mud coated tape exiting said reservoir into the finished roll around said shaft for storage within said housing.

7. The method recited in claim 6, including the additional steps of locating a hand crank at the outside of said housing in connection with said shaft and rotating said crank for causing said shaft to rotate and the mud coated tape to wind around said shaft at the interior of said housing.

8. The method recited in claim 1, including the additional steps of connecting a frame to the top of said mud reservoir, suspending said roll of uncoated tape from said frame above the mud bath in said reservoir, unwinding the uncoated tape from said suspended roll, and immersing said unwound tape in the mud bath of said reservoir so that both sides of the tape are simultaneously coated with mud.

* * * * *

UNITED STATES PATENT AND TRADEMARK OFFICE

CERTIFICATE OF CORRECTION

PATENT NO. : 5,137,752

DATED : August 11, 1992

INVENTOR(S) : Greg Mills

It is certified that error appears in the above-indentified patent and that said Letters Patent is hereby corrected as shown below:

Title page should be deleted to appear as per attached title page.

Cols. 1-8 should be deleted to appear as per attached cols. 1-8.

Signed and Sealed this

Eighth Day of June, 1993

*Attest:*

Michael K. Kirk

MICHAEL K. KIRK

*Attesting Officer*

*Acting Commissioner of Patents and Trademarks*

United States Patent [19]

Mills

[11] Patent Number: 5,137,752

[45] Date of Patent: Aug. 11, 1992

[54] GYPSUM WALLBOARD TAPING SYSTEM

[76] Inventor: Gregory B. Mills, P.O. Box 692, Newport Beach, Calif. 92661-0692

[21] Appl. No.: 633,320

[22] Filed: Dec. 24, 1990

Related U.S. Application Data

[62] Division of Ser. No. 320,272, Mar. 7, 1989, Pat. No. 4,996,941.

[51] Int. Cl.[5] ..... B05D 3/12

[52] U.S. Cl. ..... 427/179; 427/207.1; 427/439

[58] Field of Search ..... 118/419, 423; 156/527, 156/575, 577, 578, 579; 427/207.1, 209, 430.1, 179, 439

[56] References Cited

U.S. PATENT DOCUMENTS

| | | | |
|---|---|---|---|
| 387,541 | 8/1888 | Roe | 242/84.8 |
| 591,747 | 10/1897 | Eddy | 242/84.8 |
| 2,741,220 | 4/1956 | Belisle | 118/405 |
| 2,873,881 | 2/1959 | Nichols | 220/4 A |
| 3,112,225 | 11/1963 | Harms | 156/527 |
| 3,344,770 | 10/1967 | Schaefer | 118/428 |
| 4,202,288 | 5/1980 | Davy | 118/424 |
| 4,689,107 | 8/1987 | Entwistle | 156/531 |
| 4,758,291 | 7/1988 | Fechner et al. | 156/575 |

*Primary Examiner*—Michael Lusignan
*Attorney, Agent, or Firm*—Hawes & Fischer

[57] ABSTRACT

A labor saving taping system for use during the installation of gypsum wallboard, whereby the seam between a pair of adjacent drywall panels can be easily and reliably taped with paper drywall tape that has been precoated with wet adhesive mud. This system comprises the detachable interconnection of a frame and a mud reservoir. The drywall tape is fed from a supply roll and threaded along the frame for total emersion in the reservoir so as to receive a coating of mud on both sides thereof. The system also includes a taping tool comprising a hollow housing and a shaft around which the mud-coated drywall tape can be wound for storage and later use.

8 Claims, 8 Drawing Sheets

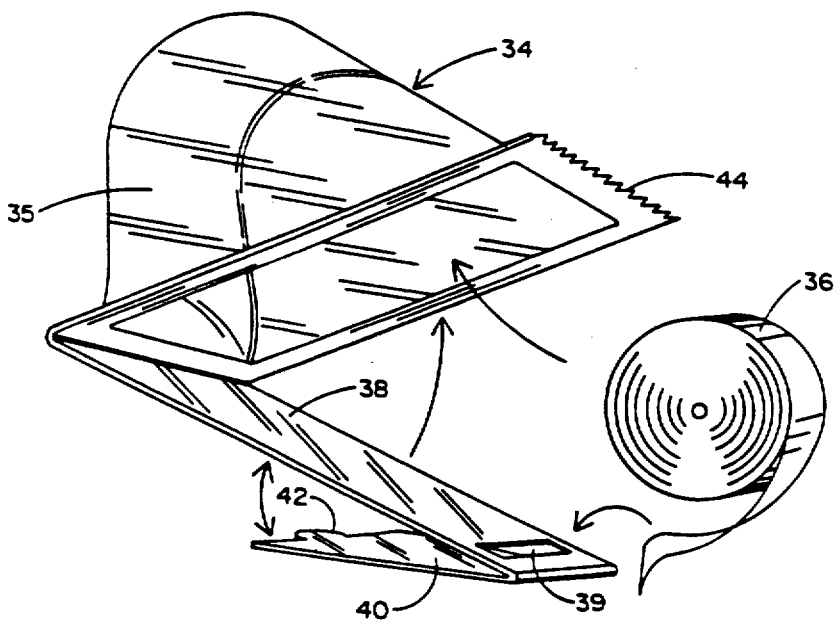

GYPSUM WALLBOARD TAPING SYSTEM

BACKGROUND OF THE INVENTION

1. Field of the Invention

This invention relates to a simplified, potentially low cost system for applying drywall tape, which has been pre-coated on both sides thereof with a wet adhesive mud, during the installation of gypsum wallboard.

2. Background Art

The repetitive and laborious process of taping drywall has led to several systems of taping, each of which having serious limitations. Since the advent of drywall technology, the taping of the seams that are created when sheets of drywall are nailed in place has been a pedestrian exercise that requires the handling of paper tape and wet adhesive mud. Such paper tape and adhesive mud are presently sold separately, such that the mud is not applied to the paper tape prior to use. In the time consuming manual application of the paper tape, the adhesive mud is manually scooped out of a container and applied with a smearing action to drywall seams with a drywall knife. The paper tape is then unrolled so as to be laid upon the seam and wiped down into the wet mud. The tape is later top coated with more mud and wiped smooth after each coat to flatten the tape surface. In the conventional time consuming, manual taping method just described, one layer of mud is applied under the paper tape to achieve adhesion, and at least two additional layers of mud are commonly applied over the tape to embed the tape within the mud. The top layers of mud are applied and wiped down until the mud appears smooth and the gap between the drywall sheets is made flat. The mud should be allowed to dry between successive coats.

One well known commercial taping system is sometimes known as the Ames system. The Ames system consists of a series of tools that are designed to handle both dry, non-adhesive paper tape and wet adhesive mud to make the tape applying procedure faster than if it were manually completed. The tools of the Ames system generally consist of a manual mud pump, a taping tool, a roller, finishers and a standard drywall knife. Many of the Ames tools are complex, relatively expensive and require extensive training, adjustment and manual dexterity to operate. In the Ames system, the drywall mud is pumped out of a bucket into a cylinder within the Ames taping tool. This taping tool holds a roll of dry paper tape. When the cylinder of the taping tool is full of mud, the taping tool is held against the seam to be taped and the head of the taping tool is rolled along the seam. The taping tool cylinder is emptied of the mud as a wheel on the taping tool head, which contains a pulley, reels up a steel cable that is attached to a piston within the cylinder. The mud then exits the taping tool through a hole at the head as dry paper tape is rolled onto the mud as it is rejected on the wall. The seam must be wiped down with a drywall knife to complete the taping operation. The seam then requires a top coat of mud to fully embed the tape. With the Ames system, full embedding occurs only after three operations;applying tape and mud to the drywall seam; wiping the tape down; and then top coating the seam.

The aforementioned tools have various limitations and shortcomings. The Ames system is very expensive and requires unique parts which must be machined and maintained in proper adjustment. The taping tool is heavy and difficult to use, and requires that many precision parts operate in the hostile environment of gritty adhesive viscous drywall mud. The tool must be cleaned, oiled and adjusted often so as not to break down or become jammed or stop working. Parts have been known to wear out and break, thereby requiring substantial maintenance and expense. Moreover, the Ames taping tool system does not apply mud to the top side of the drywall tape.

A more primitive taping tool called a "banjo" utilizes a reel of dry tape that is threaded through a chamber of wet mud as the tape exits the tool. The muddy tape is then applied directly to the drywall seam and wiped down manually. Since the banjo concentrates all of the mud under the tape, very little mud is applied to the back side of the tape. With a banjo taping system, another coat of mud must be applied to fully embed the tape. What is more, the banjo is slow and inefficient, inasmuch as the mud may not properly and fully coat the underside of the tape, thereby leaving a dry blister. The banjo is heavy and awkward to use and requires that the muddy tape be wiped down after it is unrolled on the drywall seam. What is more, a banjo will not tape inside corners easily.

It would therefore be desirable to have an effective labor saving drywall taping system that is inexpensive to manufacture, easy to use and light in weight. The system should be able to operate in the hostile environment of the adhesive mud materials and not be adversely affected by the mud drying and/or a failure to thoroughly clean the tools after each use. The system should also utilize materials and procedures that are common to the drywall taping industry. It would be further desirable to reduce the occurrence of air blisters which are occasionally formed under the tape. The system should be able to fully embed the drywall tape during the initial application, thus reducing the number of required steps and eliminate much of the labor associated with conventional taping procedures.

SUMMARY OF THE INVENTION

In general terms, a low cost drywall taping system is disclosed for taping the seam between adjacent drywall panels. The system is easier to use and more efficient than conventional taping systems. The taping system includes a mud filled reservoir, which may be a conventional plastic bucket in which drywall mud is commonly sold, a cylindrical collar, which is detachably connected to the mud reservoir to form a vertical extension thereof, a frame which is supported from and aligned by the collar such that a roll of drywall tape can be suspended above the reservoir and threaded around the frame, and a reusable taping tool into which the tape can be wound up and stored for later use after such tape is first immersed in the mud of the reservoir and simultaneously coated on both sides.

The taping tool has a hollow housing and a centrally located shaft around which the pre-coated drywall tape is wound. A small hook protrudes from the shaft to catch the leading end of the tape after it is immersed in the mud of the reservoir. A hand crank is located at the outside of the housing to rotate the shaft and cause the pre-coated tape to be wound therearound. The taping tool has a flat base plate which slides along the seam to be taped. The base plate has an opening formed therein through which the pre-coated tape that is stored within the housing may be dispensed. The trailing end of the taping tool includes a serrated cutting edge to permit the tape to be cut at any point.

As an alternative embodiment of the invention, a roll of pre-coated drywall tape may be loaded at the factory within a disposable, one-piece taping tool. Unlike the reusable taping tool, the disposable tool has no hand crank or shaft for winding the tape. The taping tool of this embodiment includes a flat base plate having an exit opening formed therein through which the pre-coated tape is dispensed. A bottom flap is folded over and releasably sealed against the base plate to cover the exit opening with the leading end of the tape being retained between said baseplate and bottom flap.

BRIEF DESCRIPTION OF THE DRAWINGS

Figure 1:
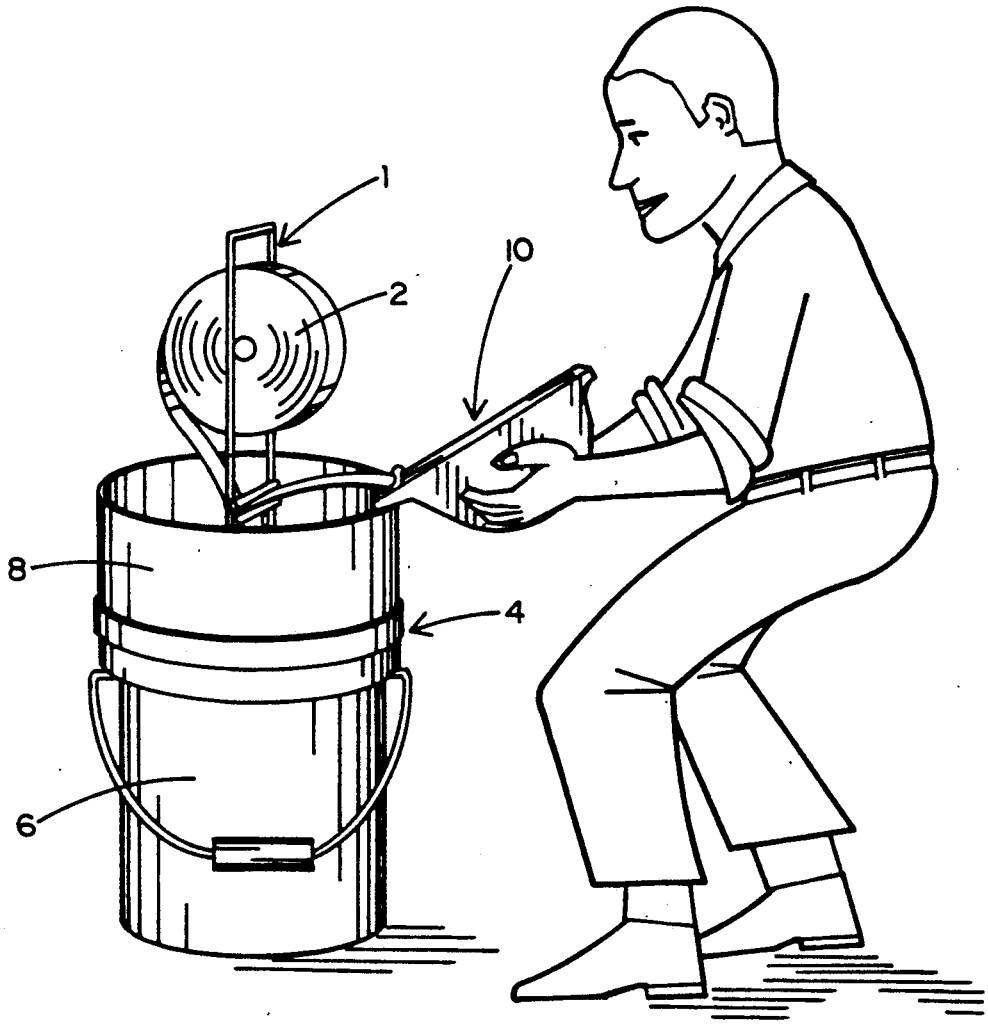
FIGS. 1. The mud bucket and taper tool in loading mode
Figure 2:
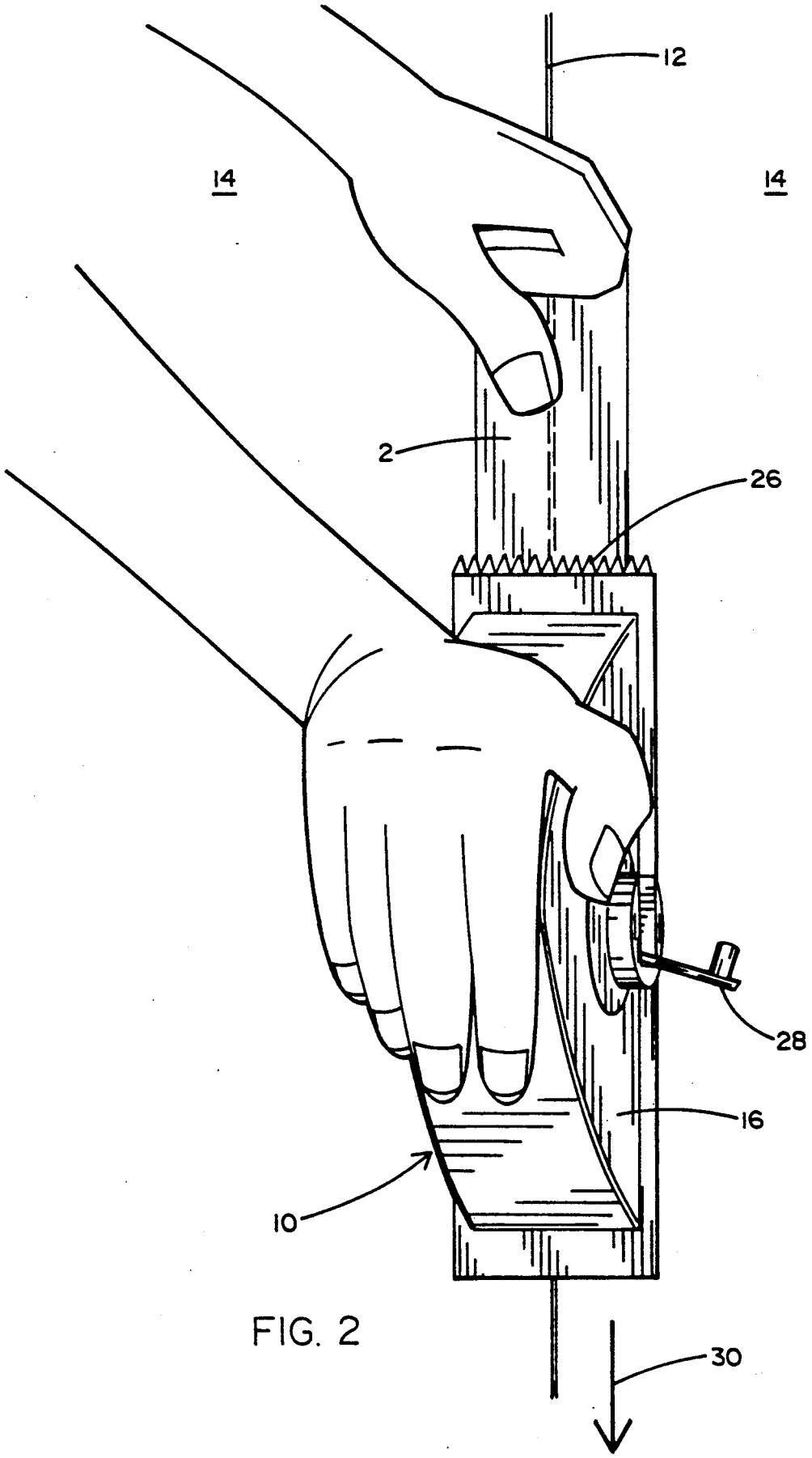
FIGS. 2. The Taper in use embedding tape, finger on tape to start

FIG. 1 shows the gypsum wallboard taping system of the present invention with a supply of pre-coated drywall tape being wound into a reusable taping tool;

FIG. 2 shows the reusable taping tool of FIG. 1 with pre-coated drywall tape being dispensed therefrom to tape the seam between a pair of drywall panels;

FIG. 3 is a partially broken away side view of the reusable taping tool of FIG. 2;

FIG. 4 is a bottom view of the reusable taping tool with its base plate removed therefrom;

FIG. 5 shows a disposable, one-piece taping tool into which a roll of pre-coated drywall tape can be loaded and stored;

FIG. 6 is a side view of the disposable taping tool of FIG. 5;

FIG. 7 is a bottom view of the disposable taping tool;

FIG. 8 is an exploded view of the taping system of FIG. 1;

FIG. 9 shows the taping system of FIG. 8 in the assembled relationship;

FIG. 10 is a front view of the frame which forms the taping system of FIGS. 8 and 9;

FIG. 11 is a side view of the frame;

FIG. 12 is an enlarged detail of the mud control bars of the frame;

FIG. 13 shows the reusable taping tool of FIG. 1 and a removable taping shoe to which the taping tool may be attached so that pre-coated tape can be dispensed from the tool for taping inside corners;

FIG. 14 shows the attachment of the taping tool to the taping shoe of FIG. 13; and FIG. 15 is an end view of the attachment of FIG. 14.

DESCRIPTION OF THE PREFERRED EMBODIMENT

FIG. 1 of the drawings shows the gypsum wallboard taping system which forms the present invention including a frame 1 which carries a roll of paper drywall tape 2 and is removably received within and supported by a mud reservoir 4. Details of the frame 1, by which both sides of the drywall tape can be reliably and efficiently coated with wet adhesive or "mud", will be described in greater detail hereinafter when referring to FIG. 9. The mud reservoir 4 which supports frame 1 includes a conventional pail or bucket 6, or the like, and a vertical extension or collar 8 which is attached to the pail 6 to support and align the frame 1 (best shown in FIGS. 8 and 9). By virtue of the presently disclosed taping system, a supply of pre-coated drywall tape may be easily rolled up and conveniently stored for later use. To facilitate handling and storage, the system also includes a reusable taping tool 10 (best shown in FIGS. 2–4) within which the pre-coated drywall tape 2 is loaded and from which the tape is dispensed during use.

FIGS. 2–4 of the drawings show the reusable taping tool 10 of FIG. 1, within which a roll of coated (i.e. premudded) drywall tape 2 is wound, so that a suitable length of such tape can be dispensed therefrom and taped over the seam 12 between a pair of adjacent panels 14 of drywall or gypsum wallboard. Taping tool 10 includes a hollow, arcuate shaped housing 16 into which the pre-coated tape 2 is to be rolled. A shaft or take-up spindle 18 (best shown in FIG. 4) around which the pre-coated tape 2 is wound extends laterally through the housing 16 of taping tool 10. A short hook 20 (also best shown in FIG. 4) projects from the shaft 18 so that the leading end of the mudded tape can be attached to and rolled up on the said shaft within housing 16. One end of the shaft 18 is interconnected with a hand crank 28 at the outside of housing 16. A rotation of hand crank 28 causes a corresponding rotation of the shaft 18 and the winding therearound of the pre-coated drywall tape 2. A removable baseplate 22 extends across the bottom of the housing 16 of taping tool 10 so that access is available to the hook 20 of shaft 18 at the interior of housing 16. A narrow opening 24 is formed in the baseplate 22 through which the pre-coated tape is wound up or played out. The trailing end of baseplate 22 is provided with a serrated cutting edge 26, whereby the pre-coated drywall tape 2 can be severed at any convenient point therealong.

In operation, the leading end of the pre-coated drywall tape 2 is dispensed from taping tool 10 via the opening 24 in baseplate 22 and held at the seam 12 to be taped (best shown in FIG. 2). The operator then pushes the taping tool 10 (in the direction of reference arrow 30) along the seam 12, such that a supply of pre-coated drywall tape 2 is played out from the housing 16. Any excess mud (designated 32 in FIG. 3), with which the tape 2 is coated, is conveniently scraped from the tape and collected within the housing 16 as the tape emerges from taping tool 10 via opening 24. Accordingly, the taping operation is relatively clean and avoids the build-up of mud deposits on the floor of the work site. After the seam 12 has been adequately taped, the tape 2 is easily cut by means of cutting edge 26. When the supply of tape within the reusable taping tool 10 is exhausted, the baseplate 22 is removed from housing 16 and a new supply of pre-coated tape is attached to hook 20 and rolled up around shaft 18 in a manner like that just described.

FIGS. 5–7 of the drawings show a disposable, one-piece taping tool 34 having a hollow housing 35 in which a roll of pre-coated tape 36 may be packaged for future use. The housing 35 is preferably manufactured from a lightweight, vacuum molded plastic (e.g. styrene). Like the housing 16 of the reusable taping tool 10 of FIGS. 2–4, the housing 35 of the disposable taping tool 34 of FIGS. 5–7 has an arcuate shape within which a pre-coated roll of drywall tape 36 is received. However, the disposable taping tool 34 is loaded with a roll of pre-coated drywall tape 36 and sealed at the factory so as to be available for one use only. Therefore, it is not necessary that taping tool 34 be provided with a hand crank (like that designated 28 in FIG. 2), since the housing 35 will not be reloaded after its tape supply is exhausted. By including anti-bacterial additives within the housing 35 of a properly sealed disposable taping tool 34, a roll of pre-coated drywall tape 36 can to have a shelf life of approximately one year.

Disposable taping tool 34 has a flat baseplate 38 which is fixedly sealed across the housing 35 after the pre-coated roll of drywall tape is loaded in said housing at the factory. An exit opening 39 is formed in the baseplate 38 of tool 34 through which the leading end of the tape supply roll 36 is pulled before the baseplate is closed against the housing 35. Hingedly attached at one end thereof to the baseplate 38 is a bottom flap 40. Protruding from the other end of bottom flap 40 is a pull tab 42. With the baseplate 38 fixedly sealed across housing 35, the flap 40 is rotated towards and releasably sealed against said baseplate 38 (best shown in FIG. 7), such that the leading end of the drywall tape 36 which is removed from housing 35 through exit slot 39 is retained between plate 38 and flap 40 (best shown in FIG. 6).

When it is desirable to gain access to the supply of pre-coated tape within the housing 35 of disposable taping tool 34, the user pulls the pull tab 42 so as to break the seal between bottom flap 40 and baseplate 38. Flap 40 is then rotated away from and broken off the baseplate 38 to permit access to the leading end of the drywall tape 36 which is located therebetween. The pre-coated tape 36 stored within disposable taping tool 34 is applied to a seam between a pair of drywall panels in the same manner as the tape 2 from the reusable taping tool 10 of FIG. 2. Moreover, the trailing end of tool 34 is provided with a serrated cutting edge 44 so that a suitable length of tape 36 may be easily cut off from the supply roll thereof. However, when the supply of tape is exhausted, the empty housing 35 is discarded, and a new package with a fresh roll of pre-coated drywall tape is opened and used in the manner just described.

FIGS. 8–12 of the drawings illustrate the details of the frame 1 and mud reservoir 4 which form the taping system shown in FIG. 1. More particularly, the frame 1 comprises a pair of vertically extending, parallel side bars 50. A pair of laterally extending, parallel support bars 52 are connected to respective side bars 50. The tops of side bars 50 are connected together to form a handle 54 by which to permit the frame 1 to be conveniently lowered into or removed from the mud reservoir 4 for the purpose of cleaning or reloading with a fresh roll of drywall tape 2. A supply hub 56 is releasably attached to frame 1 between side bars 50. In the assembled relationship, the supply hub 56 supports a roll of uncoated drywall tape 2 that is to be bathed in mud within the mud reservoir 4 and rolled up in the reusable taping tool 10 (best shown in FIG. 9).

A pair of parallel shafts 58 and 60 are also attached to frame 1 between side bars 50. Shaft 58 is located above shaft to support a rotatable separation roller 62. Shaft 60 is located near the bottom of frame 1 to support a rotatable bottom roller 64. A pair of parallel mud control bars 66 are connected between the side bars 50 below the supply hub 56 and above the separation roller 62. Mud control bars 66 are arranged in parallel alignment with supply hub 56 and shafts 58 and 60 to facilitate the threading of the drywall tape 2 around frame 1 in a manner that will soon be described. Mud control bars 66 are spaced closely together so that a small gap 68 is formed therebetween, whereby the thickness of the mud with which the drywall tape 2 is coated can be controlled, as will also soon be described.

The frame 1 is threaded with drywall tape 2 by feeding the leading end of the uncoated roll thereof downwardly along side bars 50 and around bottom roller 64. The leading end is then pulled over separation roller 62 and through the gap 68 between mud control bars 66. That portion of the tape 2 that is covered with mud from reservoir 4 may now be connected to and rolled up within the taping tool 10 in the manner previously described while referring to FIGS. 2–4 and illustrated in FIG. 9.

As earlier described, the mud reservoir 4 includes a conventional pail 6 and a vertical extension or collar 8. The pail 6 may be a five gallon plastic bucket in which drywall mud is commonly sold. The collar 8 is cylindrically shaped with an open ended top and a diaphragm 70 extending across the bottom thereof. The diameter of cylindrical collar 8 is suitably sized so that collar 8 may be detachably snap fit to the pail 6 around the rim thereof (best shown in FIG. 9). A mud filling hole 71 is formed in the diaphragm 70 of collar 8 to permit the pail 6 to be refilled with an additional supply of mud. An opening 72 is also formed in the diaphragm 70 and dimensioned to receive therethrough a portion of the frame 1, such that the bottom roller 64 is disposed within the mud supply 74 of pail 6 (also best shown in FIG. 9).

That is, and referring to the assembled configuration of FIG. 9, the pail 6 of mud reservoir 4 is filled with a bath of wet adhesive mud 74, and the frame 1 around which the drywall tape 2 is threaded is lowered through the opening 72 in diaphragm 70 until the laterally extending support bars 52 are engaged by said diaphragm. With the support bars 52 of frame 1 resting upon diaphragm 70, the roll of uncoated drywall tape 2 is suspended at supply hub 56 above collar 8, while the bottom roll 64, around which the tape 2 is threaded, will be totally immersed within the mud bath 74 of pail 6. Inasmuch as the path of the drywall tape 2 extends around bottom roller 64 and through the mud bath 74, both sides of the tape will be simultaneously coated with mud. Moreover, by passing the mudded tape 2 between mud control bars 66, excess mud will be wiped off so that the tape which exits frame 1 will have a uniform coating of mud on both sides thereof.

The taping tool 10 is then turned upside down, and, as previously disclosed, the leading end of the drywall tape 2 is connected to and wound up within said tool 10 when the user turns the hand crank thereof. Accordingly, and by virtue of the present invention, a pre-coated supply of drywall tape may be conveniently stored and easily handled in taping tool 10 so as to be dispensed therefrom and applied to the seam between drywall panels in the manner described when referring to FIG. 2.

FIGS. 13–15 of the drawings show a tape shoe 76 to which the taping tool 10 can be removably attached, such that the pre-coated tape that is dispensed from tool 10 can be applied to inside corners. The taping shoe 76 includes a flat baseplate 78 and a pair of side walls that are connected together at an angle at first ends thereof and interconnected with baseplate 78 and their opposite ends. Extending outwardly from and slightly above the sides of baseplate 78 are respective guide rails 82. Guide rails 82 are dimensioned to releasably engage the baseplate 22 of taping tool 10 so that taping shoe 76 and taping tool 10 can be attached to one another as the baseplate 22 of tool 10 slides along the baseplate 78 and under the guide rails 82 of shoe 76 (in the direction of the reference arrow). An exit opening 84 is formed in the baseplate 78 and side walls 80 of taping shoe 76 through which to dispense the pre-coated drywall tape 2 that is played out of taping tool 10. That is to say, and as is best shown by the assembled configuration of FIG. 14, as the combination taping tool 10 and taping shoe 76 slide (in the direction of the reference arrow) along the inside corners (not shown) of an area to be taped, the drywall tape 86 that is dispensed from the tool 10 and shoe 76 will be automatically folded in half by and along the bottom of angled side walls 80. More particularly the drywall tape 86 is folded, smoothed out, and embedded in mud as the angled sidewalls 80 of shoe 76 ride over the tape and along the inside corners to be taped.

The advantages of the disclosed taping system are numerous. The pre-coated drywall tape is applied and embedded in one operation, thereby resulting in a minimal number of air blisters developing under the tape. The fact that the drywall tape is pre-coated and softened prior to application produces a better tape joint than that possible with conventional taping systems. The presently disclosed system is easy to operate and is relatively fast, precise and convenient when compared with prior art taping systems. Moreover, the disclosed taping system may be used without acquiring any special training. The absence of complex mechanical apparatus will greatly reduce the possibility of breakdown and the need for repair. What is more, the relatively small size and lightweight characteristics of the taping system makes such system better suited for transport and storage, while reducing the costs of manufacture.

It will be apparent that while a preferred embodiment of the invention has been shown and described, various modifications and changes could be made without departing from the true spirit and scope of the invention.

Having thus set forth a preferred embodiment of the invention, what is claimed is:

1. A method for coating drywall tape with adhesive mud, and storing said coated tape for future use, said method comprising the steps of:

filling a reservoir with a bath of mud;

suspending a roll of uncoated drywall tape above said reservoir;

unwinding the uncoated tape from its roll and immersing said tape in the mud bath of said reservoir such that the drywall tape is coated on both sides thereof with mud; and winding the coated drywall tape into a finished roll and storing said finished roll in a housing having an opening through which said coated tape is to be dispensed in the future.

2. The method recited in claim 1, including the additional step of removably sealing the opening of said housing in which the finished roll of mud coated tape is stored.

3. The method recited in claim 1, including the additional steps of forming said housing with an open end, locating said roll of mud coated tape within said housing by way of said open end, and sealing a closure across said open end after said roll is located within said housing.

4. The method recited in claim 3, including the additional step of forming the opening in said housing through said closure.

5. The method recited in claim 1, including the additional steps of forming said housing out of disposable material and disposing of said housing after all of the mud coated tape that is stored within said housing has been dispensed therefrom.

6. The method recited in claim 1, including the additional steps of locating a shaft at the interior of said housing, attaching the leading edge of said mud coated tape to said shaft, and winding the mud coated tape exiting said reservoir into the finished roll around said shaft for storage within said housing.

7. The method recited in claim 6, including the additional steps of locating a hand crank at the outside of said housing in connection with said shaft and rotating said crank for causing said shaft to rotate and the mud coated tape to wind around said shaft at the interior of said housing.

8. The method recited in claim 1, including the additional steps of connecting a frame to the top of said mud reservoir, suspending said roll of uncoated tape from said frame above the mud bath in said reservoir, unwinding the uncoated tape from said suspended roll, and immersing said unwound tape in the mud bath of said reservoir so that both sides of the tape are simultaneously coated with mud.

* * * * *